US006196402B1

(12) United States Patent
Staats

(10) Patent No.: US 6,196,402 B1
(45) Date of Patent: Mar. 6, 2001

(54) LOGGING CARRIAGE APPARATUS

(76) Inventor: David Staats, P.O. Box 588, Garibaldi Highlands, British Columbia (CA), V0N 1T0

( * ) Notice: Subject to any disclaimer, the term of this patent is extended or adjusted under 35 U.S.C. 154(b) by 0 days.

(21) Appl. No.: 09/288,712

(22) Filed: Apr. 9, 1999

Related U.S. Application Data

(63) Continuation-in-part of application No. 08/837,321, filed on Apr. 11, 1997, now abandoned.

(51) Int. Cl.[7] ..... B66C 21/00
(52) U.S. Cl. ..... 212/91
(58) Field of Search ..... 212/76, 77, 78, 212/83, 84, 85, 86, 94, 95, 96, 97, 98, 99, 100, 101, 102, 103, 104, 105, 106, 87, 88, 89, 90, 91, 92, 93

(56) References Cited

U.S. PATENT DOCUMENTS 1,509,716 * 9/1924 Daniel .
3,712,478 * 1/1973 Rennie et al. ..... 212/89
3,776,390 * 12/1973 Junes et al. ..... 212/122
4,127,197 * 11/1978 Dumont ..... 212/122
4,164,289 * 8/1979 Haliewicz ..... 212/122
4,453,642 * 6/1984 Myhre ..... 212/78

FOREIGN PATENT DOCUMENTS

579790 * 10/1924 (FR) ..... 212/92

* cited by examiner

*Primary Examiner*—Thomas J. Brahan
(74) *Attorney, Agent, or Firm*—Norman M. Cameron

(57) ABSTRACT

The invention also provides a logging carriage which has a winding drum rotatably mounted in a body. A cable is wound about the drum, whereby the drum is rotated when the cable is pulled. A drop line sheave is rotatably mounted in the body and has a drop line extending thereabout. A drive mechanism mechanically couples the sheave to the drum, whereby rotation of the drum rotates the sheave to lower the drop line as the cable is pulled. There may be one or two other carriages, all the carriages being releasibly connected together.

11 Claims, 8 Drawing Sheets

LOGGING CARRIAGE APPARATUS

RELATED APPLICATION

This is a continuation-in-part of U.S. patent application Ser. No. 08/837,321 filed Apr. 11, 1997, now abandoned.

BACKGROUND OF THE INVENTION

This invention relates to logging carriages of the type typically used in logging operations on mountainous terrain.

Logging operations on mountainous terrain provide a challenge in retrieving the logs. Often it is not easy to drive a vehicle, even a tractor, to the location where a log has fallen. Techniques have been developed to recover such logs using cables strung between two masts. Typically the mast at one end is a tree and at the opposite end is part of a yarder which is a wheeled or treaded vehicle having the mast and winches for winding cables. A logging carriage traverses the cables between the two masts. A drop line extends downwardly from the carriage. Logs are connected to the drop line and are hoisted upwards towards the carriage. The carriage is then moved towards the yarder and dropped in a convenient location where they can be trucked away. Typical prior art carriages require some mechanism for lowering the drop line so it may be connected to logs which are subsequently lifted and carried away by the carriage. The drop line is actually just a downward extension of a generally horizontal main line extending from the mast of the yarder and connected to a winch on the yarder. The drop line typically extends about one or more sheaves within the carriage and then extends downwardly towards the ground. A mechanism can be provided for rotating the sheaves, but some device must be provided to ensure that the sheaves grip the drop line and carry it downwards towards the ground as the sheaves rotate.

For example, one type of carriage, known as the "Eagle Carriage", wraps the drop line over two vertically spaced-apart sheaves. A third sheave, connected to a hydraulic ram, squeezes the cable between the three sheaves. One of the sheaves at least is powered, often by a diesel engine. This pulls the cable downwardly as the sheaves rotate.

Often these devices are relatively heavy and expensive, particularly when they must accommodate a diesel engine and often a hydraulic pump as well. Furthermore, the devices for gripping the cables often are unreliable in operation.

Accordingly, it is an object of the invention to provide an improved gripping device for securing a cable, or other flexible, tension member, about a sheave or another such rotatable member, which is simple in construction and relatively light in weight.

It is also an object of the invention to provide a carriage capable of operating on different types of yarders and uphill or downhill terrain.

It is a further object of the invention to provide an improved gripping device which does not require an engine.

SUMMARY OF THE INVENTION

There is provided, according to one aspect of the invention, a logging carriage which includes a body with a winding drum rotatably mounted on the body. A cable is wound about the drum, whereby the drum is rotated when the cable is pulled. There is drop line sheave rotatably mounted on the body which has a drop line extending thereabout. There is a drive mechanism mechanically coupling the sheave to the drum. Rotation of the drum rotates the sheave to lower the drop line as the cable is pulled.

There is provided, according to a further aspect of the invention, a logging apparatus including a first carriage with a body having means for suspending the body from a cable. There is a brake means for releasably securing the body along the cable. A second carriage is connected to the first carriage below the first carriage. The second carriage has a body and a winding drum rotatably mounted to the body. A cable is wound about the drum, whereby the drum is rotated when the cable is pulled. A drop line sheave is rotatably mounted on the body and has a drop line extending thereabout. A drive mechanism mechanically couples the sheave to the drum. Rotation of the drum rotates the sheave to lower the drop line as the cable is pulled.

BRIEF DESCRIPTION OF THE DRAWINGS

Referring to the drawings.

DESCRIPTION OF THE PREFERRED EMBODIMENTS

Figure 1:
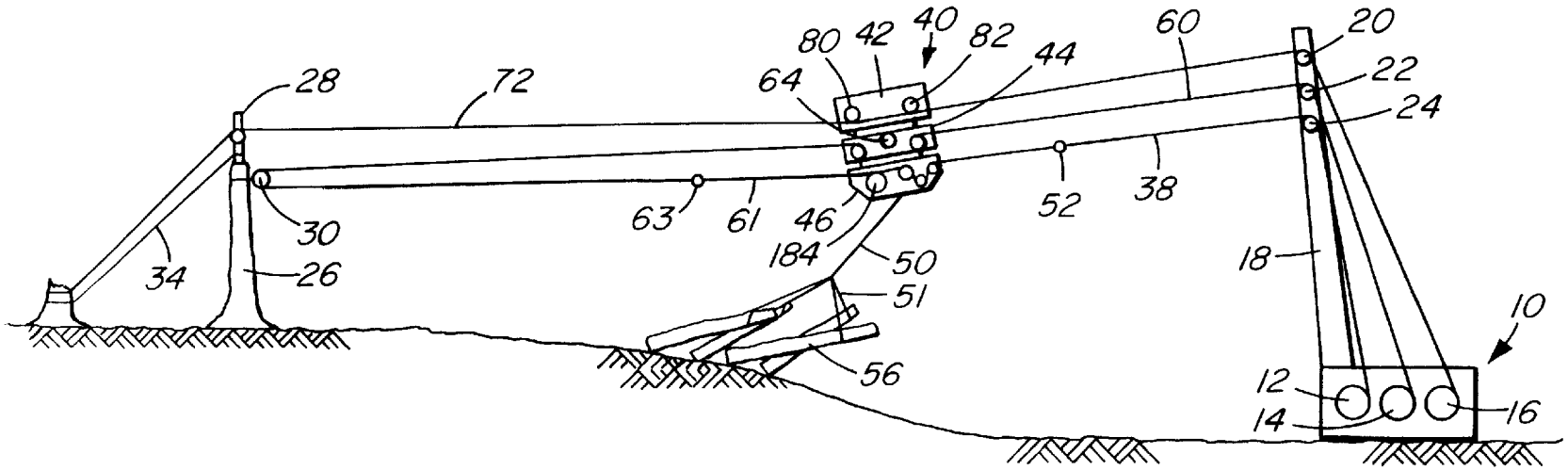
FIG. 1 is a side elevation of a logging apparatus according to an embodiment of the invention employing three carriages which are connected together, and three horizontally extending lines or cables.

Referring first to FIG. 1, this shows a logging apparatus including a yarder 10 having three winding drums 12,14 and 16 and a mast 18 having three sheaves 20, 22, and 24 near the top thereof. A second mast, comprising a tree 26 in this example, is spaced-apart from mast 18. A back spar jack 28 and a tail block 30 are connected to the tree which is supported in part by cables 72 and 34 connected to a stump or other fixed object on the ground.

A main line 38 extends from winch 12, over sheave 24 and outwards towards carriage apparatus 40. The carriage apparatus includes a top carriage 42, a middle carriage 44 and a bottom carriage 46 which are connected together. The main line 38 is connected to a drop line 50 by a connection 52. The drop line extends about one or more pulleys or sheaves in carriage 46 and downwardly where it is connected by chokers 51 to logs 56.

Haulback line 60 is wound on winch 14 and extends over sheave 22. It passes through a series of sheaves 64 in the middle carriage 44 towards block 30. The haulback line extends about the block 30 and extends towards carriage 46. Slack pulling line 61 is wrapped around a winding drum 184. Slack pulling line 61 is connected to the haulback line by connection 63.

Skyline 72 is wound on drum 16 and passes over sheave 20 towards the top carriage 42. A pair of sheaves 80 and 82 serve to suspend the top carriage from the skyline. The skyline extends to the tree 26 where it is passes over backspar jack 28 and is connected to a fixed object on the ground such as a stump.

Figure 2:
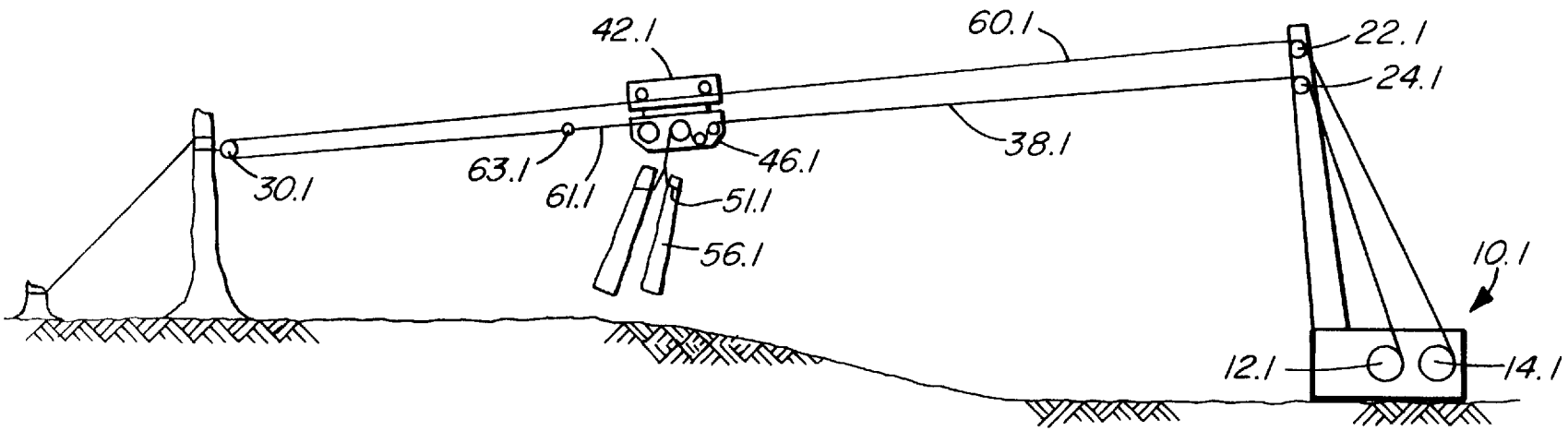
FIG. 2 is side elevation of a variation of the embodiment of FIG. 1, employing two carriages and two horizontally extending lines.

A simplified apparatus is shown in FIG. 2 where similar parts have similar numbers with the additional designation "0.1". Here there are only two carriages 42.1 and 46.1. There is no carriage equivalent to carriage 44 of FIG. 1. In this example there is no skyline. Instead, haulback line 60.1 extends from winch 14.1 over sheave 22.1 towards block 30.1. It wraps around the block and is connected to slack pulling line 61.1 at connection 63.1.

Figure 3:
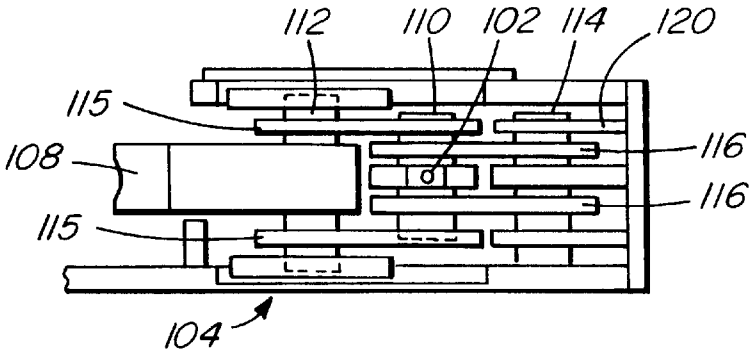
FIG. 3 is a sectional view of the top carriage of FIG. 1 taken a long line 3—3 of FIG. 4.
Figure 4:
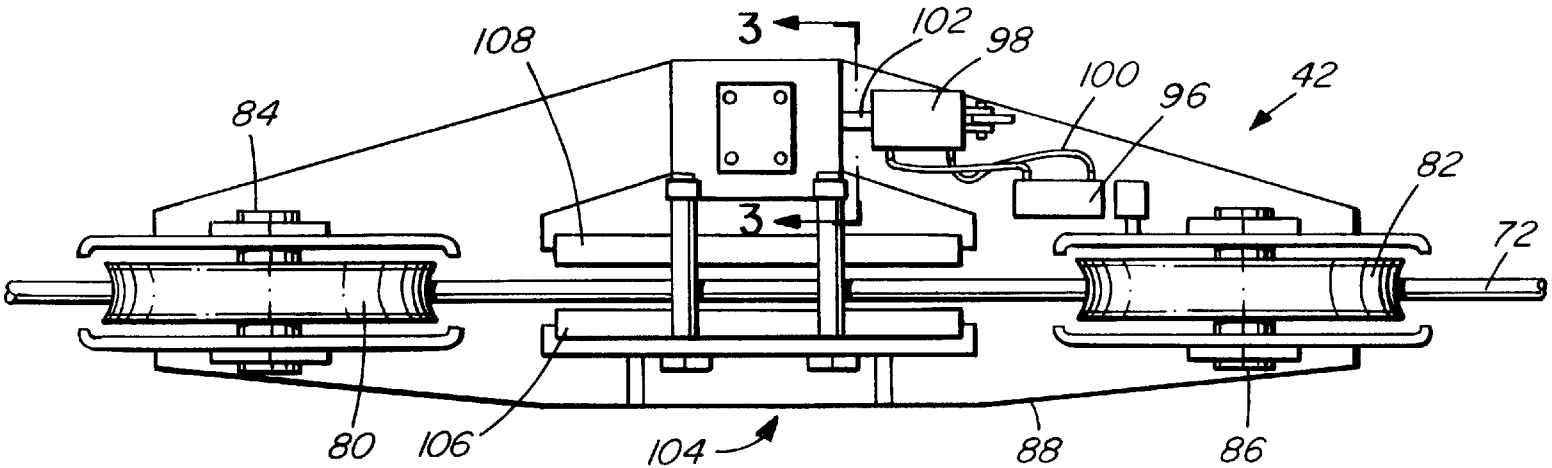
FIG. 4 is a bottom view of the top carriage of FIG. 1.

FIG. 3 and 4 show carriage 42 in more detail. It includes the pair of sheaves 80 and 82 rotatably mounted on spindles 84 and 86 which are connected to body 88 of the carriage. The sheaves 80 and 82 ride on top of skyline 72 in this example. This carriage is generally similar to a standard Eagle carriage and therefore is described only briefly. It includes a hydraulic accumulator 96 which is driven off of sheave 82. This is hydraulically connected to a hydraulic cylinder 98 by hydraulic lines 100. The cylinder has a rod 102 connected to a brake mechanism 104. The brake mechanism includes a pair of brake shoes 106 and 108 on opposite sides of skyline 72.

Referring to FIG. 3, rod 102 is connected to a pin 110 which is connected to pins 112 and 114 by pairs of links 115 and 116 respectively. Pin 114 is effectively mounted by means of lugs 120. Pin 112 goes through brake shoe 108. When rod 102 pulls on pin 110, pin 112 and the brake shoe 108 are pulled, the brake is released. When the rod pushes on pin 110, the pins and links go slightly over center to engage the brake on the cable 72 and lock the brake in place.

Figure 6:
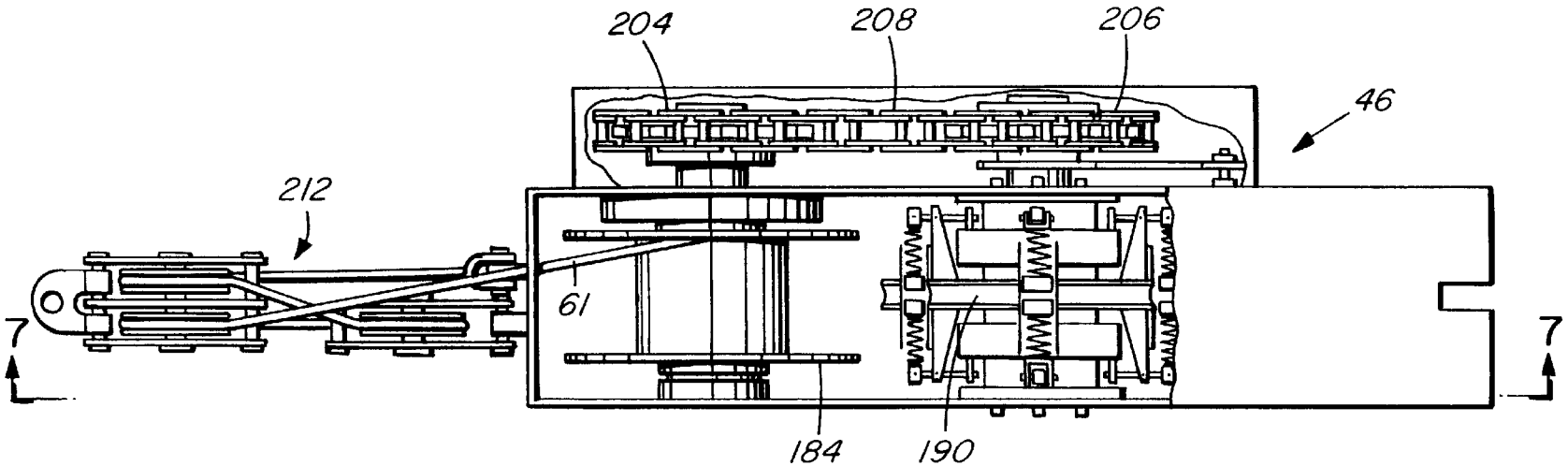
FIG. 6 is a top view, partly broken away, of the bottom carriage thereof.
Figure 7:
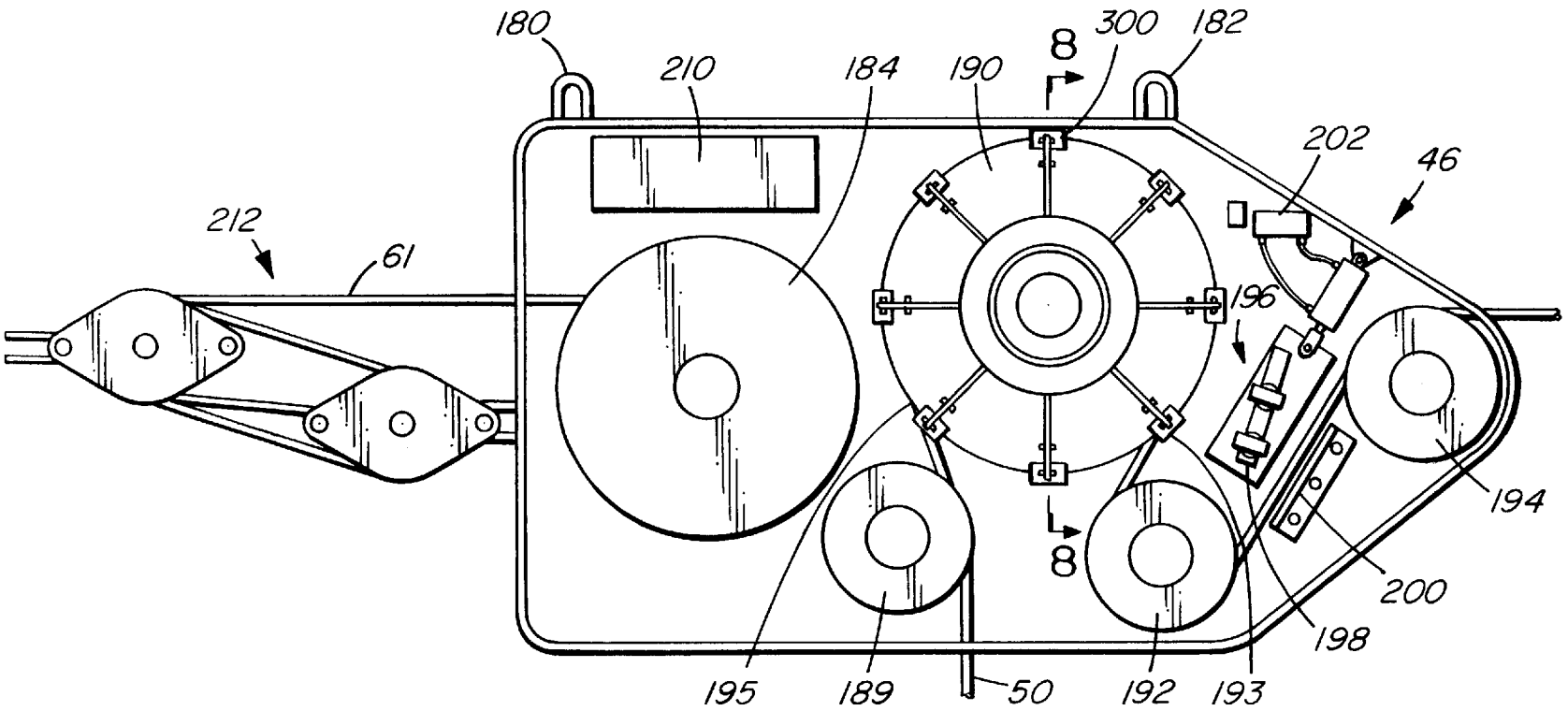
FIG. 7 is a sectional view taken a long line 7—7 of FIG. 6.

Referring to FIG. 6 and 7, carriage 46 has the winding drum 184 for slack pulling line 61. The carriage 46 also includes a series of four sheaves 189, 190, 192 and 194. Drop line 50 extends over sheaves 189 and 190, below sheave 192 and over sheave 194. Sheave 190 is larger than the sheaves 192 and 194 in this example.

There is a brake mechanism 196 to secure the drop line in any particular position. This includes brake blocks 198 and 200 . Brake block 200 is anchored to part of the carriage.

There is a hydraulic accumulator 202 powered by winding drum 184 acting through sprockets 204 and 206 and chain 208. The brake is controlled by a remote control unit 210.

There is a block and tackle 212 connected to cable 61 adjacent the winding drum 184. This acts in a manner similar to a gear box to reduce the power of the haulback. It reduces strain on the winding drum and associated components. Effectively it puts two-thirds of the power of the haulback on the body of carriage 46 and one-third on the winding drum 184. It reduces the amount of slack pulling cable 61 between the carriage and the haulback. It creates enough friction to keep the carriage suspended when the main line is slack.

The carriage 46 also includes a gripping device for securing the drop line 50 to the sheave 190 so that the drop line is raised or lowered when the sheave 190 is rotated. The sheave is rotated by chain 208 connected to the drum 184. Thus, the when the slack pulling line 61 is pulled, drum 184 is rotated and causes sheave 190 to rotate counterclockwise, from the point of view of FIG. 2, to lower the drop line.

The gripping device includes a plurality of clamps 300 spaced-apart about the sheave 190. Eight such clamps 300 are used in this embodiment and are spaced-apart at 45° intervals as shown best in FIG. 7.

Figure 8:
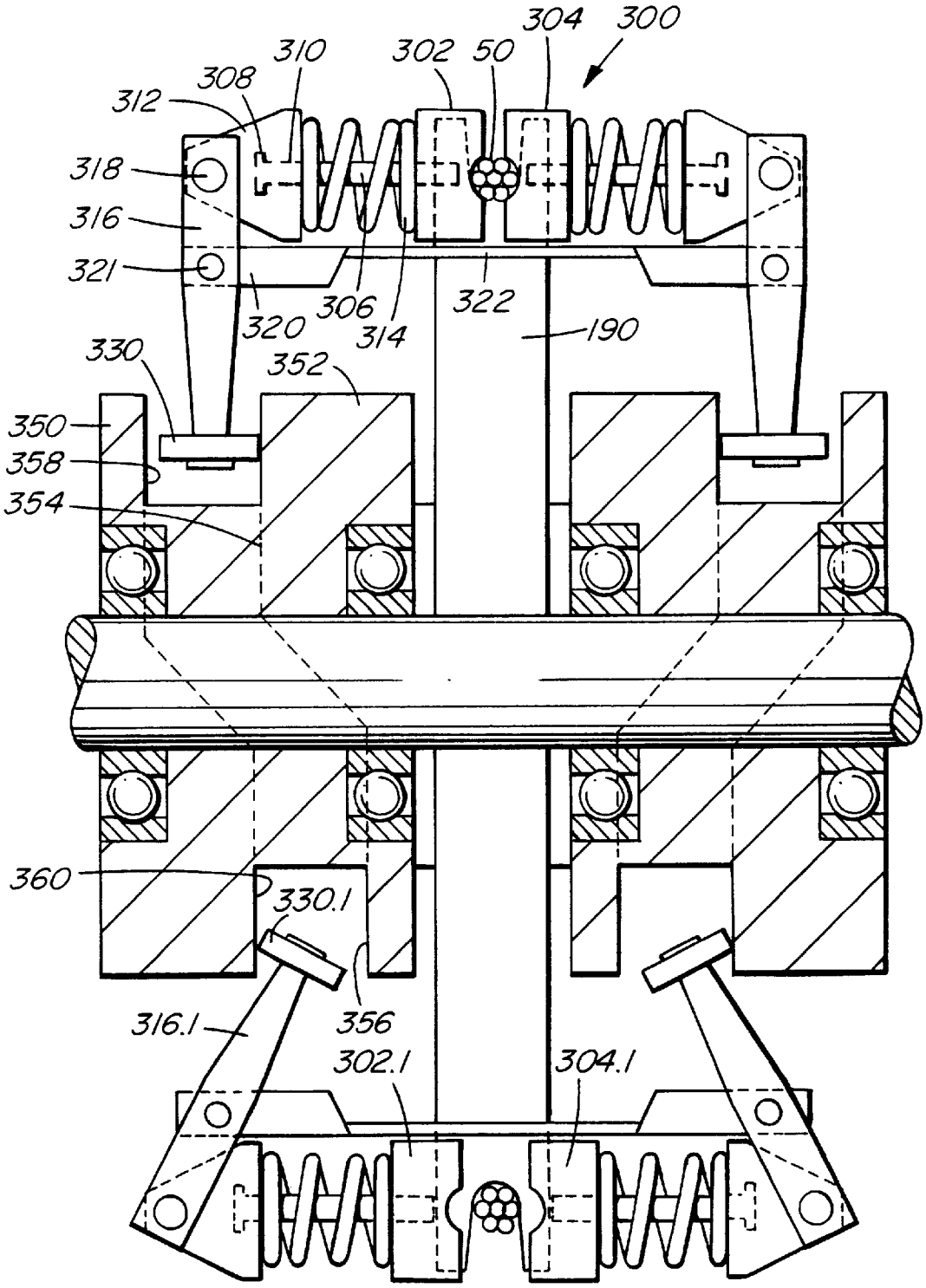
FIG. 8 is a sectional view taken a long line 8—8 of FIG. 7 showing the drop line sheave and cable gripping mechanism thereof.
Figure 9:
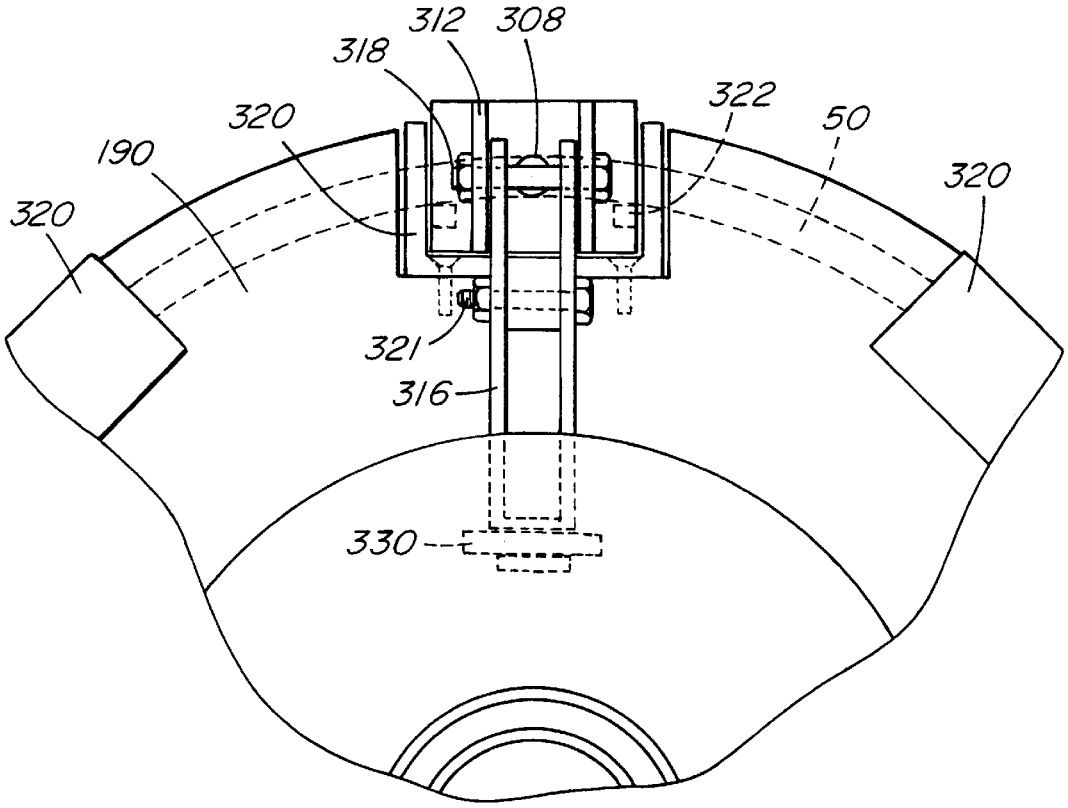
FIG. 9 is an enlarged, fragmentary side elevation of the drop line sheave and one of the clamps of the carriage of FIG. 5.

As seen in FIG. 8, each clamp 300 includes two clamp members 302 and 304 on opposite sides of cable 50. Each clamp member is fixedly connected to a rod 306 with an enlarged head 308. The rod passes slidably through an aperture 310 in a lever mount 312. A coil spring 314 is compressed between the clamp members 302 and 304 and the lever mount. A lever 316 is pivotally mounted on the lever mount by a pin 318. Each lever is pivotally connected to clamp housing slider 320 by a pin 321. Each clamp can slide in clamp housing slider 320 along guides 322.

A wheel 330 is rotatably mounted on the lever at the end opposite pin 318. Each wheel engages one of two guide members 350 and 352 which are cams fixedly located on each side of the sheave 190. Guide member 352 has a face 354 extending part way about the sheave and a face 356 on the remaining portion extending about the sheave. Face 354 is further from the sheave 190 than face 356. Guide member 350 has a face 358 which extends about the sheave the same angular extent as face 354. Likewise its face 360 extends about the sheave the same angular distance of face 356 as member 352. Face 358 is further from the sheave than face 360. Thereby it may be seen that wheel 330 rotates about the guide members 350 and 352 as the sheave rotates and is reciprocated back and forth as may be seen by comparing the top and bottom portions of FIG. 8. In the top position, described above, lever 316 is rotated away from the sheave, causing clamp member 302 to move into engagement with the cable 50. A similar mechanism is used to engage clamp member 304 with the cable 50 at the same time.

The bottom portion of FIG. 8 shows another such lever 316.1 rotated towards the sheave 190 by face 360 of member 350. This causes the clamp member 302.1 to move out of engagement with the cable 50.

The guide members extend about the sheave 190 such that the clamp members engage the cable 50 just above sheave 192 at point 193 shown in FIG. 7 and release the cable at the position 195 shown in FIG. 7. Thus the clamp members securely engage the cable with the sheave so the sheave can pull the drop line downwardly as the cable wraps over the sheave 190 between these two positions. However it allows the cable to run onto the sheave and wind off the sheave at the required points.

Figure 5:
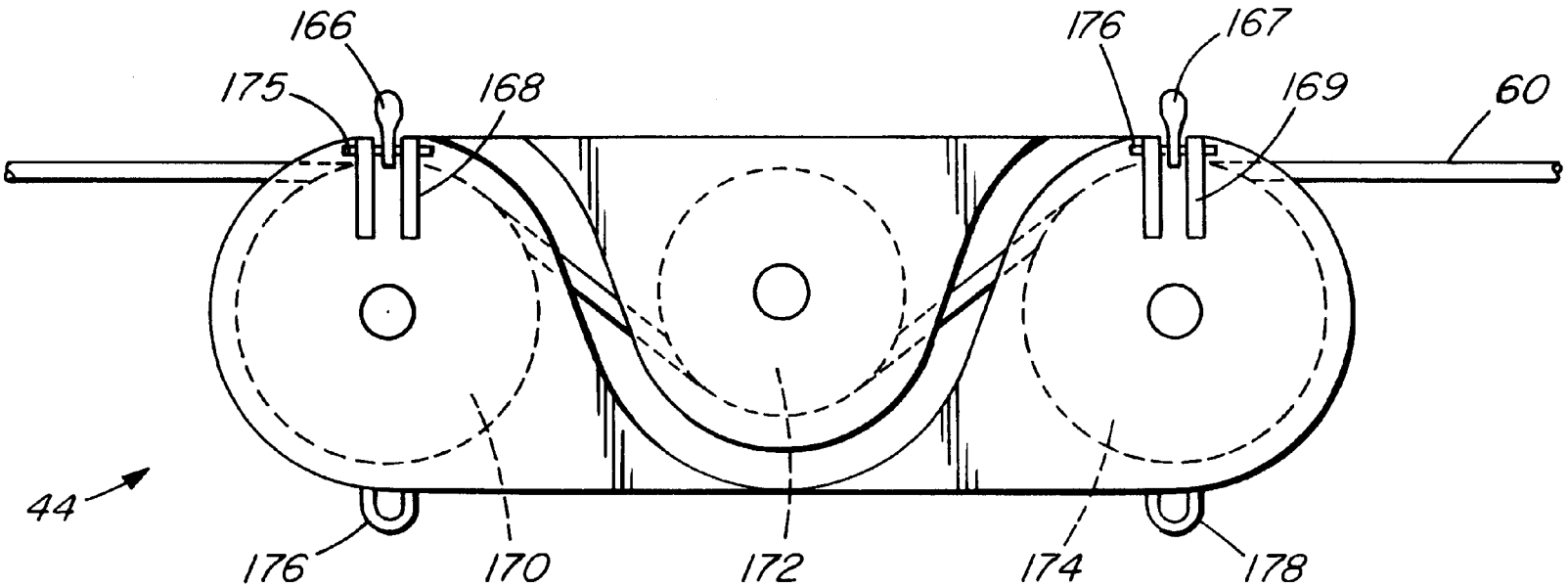
FIG. 5 is a side view of the middle carriage thereof.

Carriage 44 in shown in FIG. 5. Carriage 42 has two downwardly extending lugs 166 and 167 which are engagable with space-apart lugs 168 and 169 of carriage 44. Cannons 175 and 176 are inserted through apertures in the lugs to connect the carriages 42 and 44 together or release them. A series of three sheaves 170, 172 and 174 receive haulback line 60 in carriage 44. The haulback line passes over sheaves 170 and 174 and below sheave 172 in this example. The carriage also has two lugs 176 and 178 used to connect the carriage to lugs 180 and 182 of carriage 46 shown in FIG. 7.

Operation

Referring first to FIG. 1, the invention relates to lowering chokers 51 which are connected to drop line 50. Initially all three carriages are held in place by applying the brakes 159 in carriage 42 as shown in FIG. 7 and 8. This secures carriage 42, and accordingly the other two carriages 44 and 46, along the skyline 72. Brake 196 within carriage 46, shown in FIG. 7 is released.

Haulback line 60 is wound onto winch 14 and main line 38 is released from winch 12. This pulls slack pulling line 61 off of drum 184 as shown in FIG. 7. The rotation of drum 184 causes sheave 190 to rotate counterclockwise from the point of view of FIG. 5. Clamps 300 close after engaging drop line 50 just above the position of clamp 300.3 shown in FIG. 5. All of the clamps positioned beyond clamp 300.3 in a clockwise direction engage the cable 50 until they reach the position of clamp 300.2. At that point the clamps release, allowing the drop line to descend vertically as shown in FIG. 5. The clamps 300 effectively secure the drop line to the sheave 190 and thus pull the drop line downwards as required. The crew takes the chokers 51 and secures them to the logs 56. The above method is then reversed to pull the chokers and logs off the ground.

The variation of FIG. 2 works by applying the brakes 159 in carriage 42.1 which are identical to the brakes 159 of carriage 42 shown in FIG. 7 and 8. This secures carriage 42.1 to haulback line 60.1. The carriage 46.1 has an internal structure the same as carriage 46 shown in FIG. 5. The brake 196 his released. Main line 38.1 is released from winch 12.1. The rest of the operation is the same as described for FIG. 1 above.

It will be understood by someone skilled in the art that many of the details discussed above are by way of example only and they are not intended to limit the scope of the invention which is to be interpreted with reference to the following claims.

What is claimed is:

1. A logging carriage comprising:

a body;

a winding drum rotatably mounted on the body;

a cable wound about the drum, whereby the drum is rotated when the cable is pulled;

drop line sheave rotatably mounted on the body having a drop line extending thereabout; and means for lowering the drop line, including a drive mechanism mechanically coupling the sheave to the drum, whereby rotation of the drum rotates the sheave to lower the drop line as the cable is pulled.

2. A logging apparatus, comprising:

a first carriage with a first body having means for suspending the first body from a first cable and a brake means for releasably securing the first body along the first cable; and a second carriage connected to the first carriage below the first carriage end including a second body, and means for lowering a drop line, including a winding drum rotatably mounted in the second body, a second cable wound about the drum, whereby the drum is rotated when the second cable is pulled, a drop line sheave rotatably mounted in the second body having the drop line extending thereabout, and a drive mechanism mechanically coupling the sheave to the drum, whereby rotation of the drum rotates the sheave to lower the drop line as the second cable is pulled.

3. An apparatus as claimed in claim 2, further including a third carriage connected between the first carriage and the second carriage having means for suspending the third carriage from another cable.

4. An apparatus as claimed in claim 2, wherein the first carriage includes sheaves receiving the first cable.

5. An apparatus as claimed in claim 2, wherein the brake means includes a hydraulically activated brake.

6. An apparatus as claimed in claim 2, wherein the drive mechanism includes a drive chain and sprockets coupled to the drop line sheave.

7. An apparatus as claimed in claim 2, wherein the second carriage includes a cable brake releasibly engaging the drop line.

8. A logging carriage comprising:

a body;

a winding drum rotatably mounted on the body;

a cable wound about the drum, whereby the drum is rotated when the cable is pulled;

a drop line sheave rotatably mounted on the body having a drop line extending thereabout;

a drive mechanism mechanically coupling the sheave to the drum, whereby rotation of the drum rotates the sheave to lower the drop line as the cable is pulled; and a gripping device for securing the drop line about the drop line sheave, the gripping device including a plurality of clamps spaced-apart about the drop line sheave, an engagement mechanism adjacent the drop line sheave which engages the clamps at a first position and a release member which disengages the clamps at a second fixed position.

9. A logging apparatus, comprising:

a first carriage with a first body having means for suspending the first body from a first cable and a brake means for releasably securing the first body along the first cable; and a second carriage connected to the first carriage below the first carriage and including a second body, a winding drum rotatably mounted in the second body, a second cable wound about the drum, whereby the drum is rotated when the second cable is pulled, a drop line sheave rotatably mounted in the second body having a drop line extending thereabout, and a drive mechanism mechanically coupling the sheave to the drum, whereby rotation of the drum rotates the sheave to lower the drop line as the second cable is pulled; and a gripping device for securing the drop line about the drop line sheave, the gripping device comprising a plurality of clamps spaced-apart about the drop line sheave, an engagement mechanism adjacent the rotatable member which engages the clamps at a first fixed position, and a release mechanism which disengages the clamps at a second fixed position.

10. A logging apparatus, comprising:

a first carriage with a first body having means for suspending the first body from a first cable and a brake means for releasably securing the first body along the first cable; and a second carriage connected to the first carriage below the first carriage end including a second body, a winding drum rotatably mounted in the second body, a second cable wound about the drum, whereby the drum is rotated when the second cable is pulled, a drop line sheave rotatably mounted in the second body having a drop line extending thereabout, and a drive mechanism mechanically coupling the sheave to the drum, whereby rotation of the drum rotates the sheave to lower the drop line as the second cable is pulled; and a third carriage connected between the first carriage and the second carriage having means for suspending the third carriage from another cable.

11. An apparatus as claimed in claim 10, wherein the third carriage has a plurality of sheaves receiving the third cable.

* * * * *